United States Patent [19]

Katsuma et al.

[11] Patent Number: 4,967,120

[45] Date of Patent: Oct. 30, 1990

[54] ELECTRON GUN ASSEMBLY OF COLOR RAY TUBE

[75] Inventors: Takashi Katsuma, Tokyo; Hideo Mori; Toshio Shimaohgi, both of Fukaya; Naoaki Umezu, Ageo, all of Japan

[73] Assignee: Kabushiki Kaisha Toshiba, Kawasaki, Japan

[21] Appl. No.: 484,004

[22] Filed: Feb. 23, 1990

Related U.S. Application Data

[63] Continuation of Ser. No. 172,544, Mar. 24, 1988, abandoned.

[30] Foreign Application Priority Data

Mar. 30, 1987 [JP] Japan ..... 62-74401

[51] Int. Cl.[5] ..... H01J 29/38; H01J 29/46; H01J 29/50; H01J 29/74

[52] U.S. Cl. ..... 315/382; 315/15; 313/414; 313/437

[58] Field of Search ..... 315/14, 15, 16, 382, 315/382.1, 368; 313/414, 412, 449, 437, 452, 460

[56] References Cited

U.S. PATENT DOCUMENTS 2,752,129 11/1958 Van Dorsten .
4,288,718 9/1981 Blacker et al. ..... 313/414
4,742,279 5/1988 Gerritsen et al. ..... 313/414

FOREIGN PATENT DOCUMENTS 0231964 8/1987 European Pat. Off. .
3614700 11/1986 Fed. Rep. of Germany .
3741202 6/1988 Fed. Rep. of Germany .
61-42841 3/1986 Japan .
61-74246 4/1986 Japan .

OTHER PUBLICATIONS

Japanese Abstract vol. 10, No. 244 (E-430) (2300) Aug. 22, 1986.
Shirai et al., "Quadrupole Lens for Dynamic Focus and Astigmatison Control in an Elliptical Aperture Lens Gun" SID 87 Digest pp. 162-165, 1987.

*Primary Examiner*—Gregory C. Issing
*Attorney, Agent, or Firm*—Cushman, Darby & Cushman

[57] ABSTRACT

In an electron gun assembly of an in-line type, electron beams emitted from cathode pass through first, second and third grid electrodes and are accelerated and controlled by the electrodes. The accelerated and controlled electron beams are converged by a fourth grid electrode structure and are also focused on the phosphor screen by fifth and sixth grid electrodes. The fourth grid electrode structure is comprised of first to third electrode segments having apertures through which electron beams pass. The first and third electrode segments is maintained at a variable potential which is varied in accordance with a deflection of the electron beams and the second electrode segment is maintained at a constant potential.

7 Claims, 5 Drawing Sheets

FIG. 5A
(PRIOR ART)
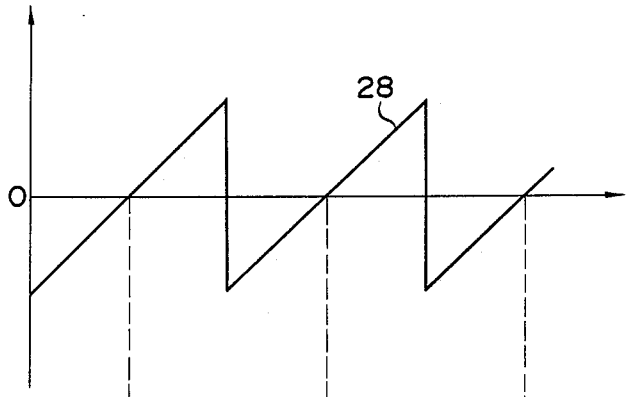
FIG. 5B
(PRIOR ART)
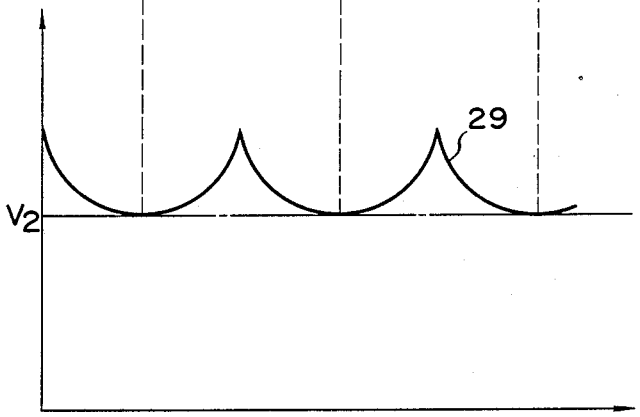
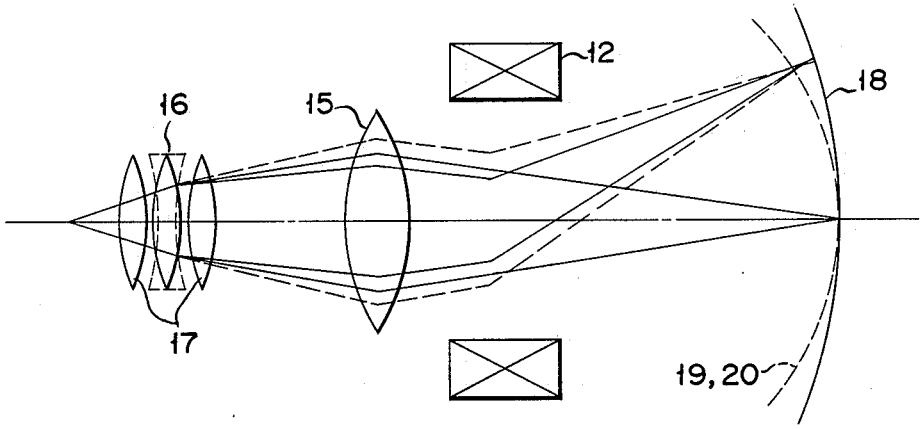
FIG. 6 (PRIOR ART)

ELECTRON GUN ASSEMBLY OF COLOR RAY TUBE

This is a continuation of application No. 07/172,544, filed March 24, 1988 which was abandoned upon the filing hereof.

BACKGROUND OF THE INVENTION

1. Field of the Invention

The present invention relates to a color cathode ray tube, and more specifically to an improvement of an electron gun assembly thereof.

2. Description of the Related Art

Conventionally, an electron gun assembly of an inline type is used in a color cathode ray tube. It includes three electron guns arranged in line with one another. The resolution characteristic of the color cathode ray tube with this arrangement is lowered by a deflective aberration such that beam spots on a phosphor screen become greater as electron beams are deflected from the center region of the screen toward the peripheral region thereof. Supposedly, this aberration consists of two superposed deflective aberrations.

A first deflective aberration is caused since the more the electron beams are deflected, the longer the paths of the electron beams from the electron guns to the phosphor screen become. If a proper focusing voltage is applied to the electron guns, the focused electron beams can form small enough beam spots in the center region of the phosphor screen. In the peripheral region of the screen, however, the electron beams are over-focused, so that the beam spots are subject to the deflective aberration.

A second deflective aberration is caused due to the nonuniformity of deflection magnetic fields. Thus, in the color cathode ray tube having the in-line electron gun assembly therein, a pincushion-shaped horizontal deflection magnetic field and a barrel-shaped vertical deflection magnetic field are formed as shown in FIGS. 1A and 1B, respectively. Electron beams 21, 22 and 23 impinge on a same position of the phosphor screen by these magnetic fields. In these nonuniform magnetic fields, beams 21, 22 and 23 are subjected to a diverging effect in the horizontal direction and a converging effect in the vertical direction. Thus, the beams are distorted or extended horizontally. Such a deformation, i.e., deflective aberration, is particularly great in the peripheral region of the phosphor screen, so that the resulting beam spots are noncircular.

Under the influences of the first and second deflective aberrations, the electron beams are landed on the phosphor screen, tracing in the manner shown in FIG. 2. In FIG. 2, full lines indicate a path within a horizontal plane, while broken lines indicate a path within a vertical plane. If the electron beams, within the horizontal and vertical planes, are deflected from the center region to the peripheral region of phosphor screen 18, with the focusing voltage for the electron guns adjusted so that the beams are focused on the center region, the beams are subjected to the diverging effect, influenced by the second deflective aberration within the horizontal plane, due to the presence of the nonuniform deflection magnetic field formed by deflection yoke 12. Thus, the electron beams are under-focused on phosphor screen 18. The wider the deflection angle of the electron beams, the longer is the beam path under the influence of the first deflective aberration. Accordingly, the electron beams are over-focused on phosphor screen 18. This over-focusing effect, however, is reduced by the under-focusing effect produced under the influence of the second deflective aberration. As indicated by numeral 19 in FIG. 2, therefore, a focusing plane within the horizontal direction is synthetically formed inside phosphor screen 18, that is, on the electron gun electron gun assembly side thereof. If the electron beams, within the horizontal and vertical planes, are deflected from the center region to the peripheral region of the phosphor screen in a manner such that the beams are focused on the center region, the beams are subjected to the converging effect, influenced by the second deflective aberration within the vertical plane, due to the presence of the nonuniform deflection magnetic field. Thus, the electron beams are over-focused on phosphor screen 18. The wider the deflection angle of the electron beams, the longer is the beam path under the influence of the first deflective aberration. Accordingly, the electron beams are additionally over-focused on phosphor screen 18. As indicated by numeral 20 in FIG. 2, therefore, a focusing plane within the vertical direction is synthetically formed inside the horizontal focusing plane 19, that is, on the assembly side thereof.

Due to these influences of the deflective aberrations on the electron beams, as shown in FIG. 3, circular beam spot 24 is formed in the center region of the phosphor screen, while noncircular beam spots, each consisting of high-luminance core 26 and low-luminance halo 27, are formed in the peripheral region of the screen. Thus, the resolution is degraded in the peripheral region.

Conventionally proposed in Japanese Patent Disclosure No. 61-74246 is a method for correcting the distortion of the beam spots in the peripheral region of the phosphor screen. A quadra-potential electron gun assembly disclosed therein comprises cathodes 1 and first, second, third, fourth, fifth, and sixth grids 2, 3, 4, 5, 6 and 7, as shown in FIG. 4. Fourth grid 5 is composed of first, second, and third members 8, 9 and 10. First and third members 8 and 10 each have three electron circular beam apertures, while second member 9 have horizontally elongated, rectangular electron beam apertures 14. Predetermined voltage $V_2$ is applied to first and third members 8 and 10, and dynamic voltage Vd, which changes depending on the deflection amount or deflection angle of the electron beams, is applied to second member 9. If the deflection amount of the electron beams is zero, dynamic voltage Vd has the same level as predetermined voltage $V_2$. As the deflection amount increases, the level of voltage Vd lowers gradually from $V_2$. Thus, asymmetrical lenses are formed between three members 8, 9 and 10, which constitute fourth grid 5, only if the electron beams are deflected.

In the electron gun assembly disclosed in Japanese Patent Publication No. 61-74246, the asymmetrical lenses apply strong and weak focusing effects to the electron beams passing through the lenses, within the vertical and horizontal planes, respectively. Accordingly, the electron beams should be deformed into the shape of an oval having its major axis within the horizontal plane, and should be incident on a main lens between fifth and sixth grids 6 and 7. In order to form the asymmetrical lenses, as seen from the electrode arrangement shown in FIG. 4, dynamic voltage Vd must be lowered as the deflection amount increases. If dynamic voltage Vd is lowered, the focusing power of a unipotential lens between third and fifth grids 4 and 6 is enhanced, so that the electron beams are positively over-focused on the peripheral region of the phosphor screen. Thus, in the electrode arrangement of FIG. 4, the first deflective aberration becomes so great that the focusing effect of the electron beams in the peripheral region of the phosphor screen will be degraded. The oval-sectioned electron beams incident on the main lens are subjected to strong and weak focusing effects within the horizontal and vertical planes, respectively, due to the spherical aberration of the main lens. These focusing effects are exerted on the electron beams so as to cancel the diverging and focusing effects within the horizontal and vertical planes, which are exerted on the electron beams in nonuniform magnetic fields and cause the second deflective aberration. Thus, according to this patent disclosure, the deflective aberrations are said to be reduced, and the resolution is said to be restrained from being lowered in the peripheral region of the phosphor screen.

In their consideration and discussion as described above, however, the fact that the asymmetrical lens themselves will function astigmatically so as to enhance the second deflective aberration has been ignored.

That is, in order to form the horizontally elongated beam shape in the region between the asymmetrical lens and the main lens, the asymmetrical lens must function so as to converge the beams strongly in the vertical direction and so as to diverge or converge the beams weakly in the horizontal direction.

Such astigmatic functions of the asymmetrical lens coincide with those of the second deflective aberration of the deflection yoke. Thus, the second deflective aberration will be also enhanced so that the resolution in the peripheral region of the phosphor screen may be degraded.

In contrast with the arrangement disclosed in Japanese Patent Disclosure No. 61-74246, a proposal can be deduced such that voltage Vd, whose level changes in synchronism with current 28 supplied to deflection yoke 12, as indicated by numeral 29 of FIG. 5B, is applied to member 9 of fourth grid 5. In proposal, as shown in FIGS. 5A and 5B, voltage Vd has the same level as predetermined voltage V2 when the deflection amount is zero. As the deflection amount increases, the level of voltage Vd rises gradually. According to this proposal, the deflective aberrations can be corrected by applying voltage Vd to member 9 of fourth grid 5. In the electron gun assembly in which the voltage as shown in FIG. 5B is applied to member 9 of fourth grid 5, asymmetrical lenses 16 are formed between three members 8, 9 and 10 of fourth grids 5, as shown in FIG. 6, only if the electron beams are deflected. As shown in FIG. 6, moreover, symmetrical lenses 17 are formed individually between third grid 4 and first member 8 of fourth grid 5 and between fifth grid 6 and third member 10 of fourth grid 5. Asymmetric lenses 16 exert a weak converging effect on the electron beams within the horizontal plane, and a diverging effect on the beams within the vertical plane. Thus, after passing through lenses 16, the electron beams are deformed into the shape of an oval having its major axis within the vertical plane. Also in FIG. 6, broken lines indicate an electron beam path within the vertical plane, while full lines indicate a path within the horizontal plane.

In the electron gun assembly having the electrooptical system shown in FIG. 6, the diverging effect within the vertical plane is exerted so that the beam spots are under-focused on phosphor screen 18. Therefore, the beam spots can be prevented from being over-focused within the vertical plane due to the second deflective aberration. Accordingly, focusing plane 20 on which electron beams are focused in the vertical direction can be brought close to phosphor screen 18. Since the weak converging effect within the horizontal plane acts so that the beam spots are slightly overfocused, focusing plane 19 on which electron beams are focused in the horizontal direction is moved from the side of screen 18 toward the electron gun assembly. As a result, focusing planes 19 and 20 within the vertical and horizontal directions can be made coincident in the peripheral region of phosphor screen 18. Thus, the second deflective aberrations are reduced.

However, if the focusing plane within the horizontal and vertical directions are coincident in the peripheral region of phosphor screen 18, then they are formed on the same side of screen 18 as the electron gun assembly. Within the horizontal and vertical planes, therefore, the beam spots are over-focused and cannot have their minimum possible diameter. This is because asymmetrical lenses 16 are so much weaker than symmetrical lenses 17 that the first deflective aberration can be corrected only insufficiently although the second deflective aberration is properly corrected. Thus, the resolution in the peripheral region of the phosphor screen cannot be fully improved. In order to further improve the resolution, this system should be combined with a dynamic focusing system such that the first deflective aberration is positively compensated by raising the voltage of fifth grid 6, as the deflection amount increases, weakening the focusing effect of main lens 15. This dynamic focusing system, however, requires a voltage modulator circuit as well as dynamic voltage Vd. Also, a dynamic focusing circuit requires withstand voltage compensation, since the reference voltage is at least several kilovolts. Thus, the visual display unit may possibly be increased in costs.

SUMMARY OF THE INVENTION

The object of the present invention is to provide a color cathode ray tube ensuring high resolution throughout its phosphor screen.

According to the present invention, there is provided a color cathode ray tube comprising a phosphor screen; electron gun means for generating three electron beams toward the phosphor screen, the means including; cathode means for emitting the electron beams; first electrode means for accelerating and controlling the emitted electron beams; second electrode means for converging the accelerated and controlled electron beams on the phosphor screen and composed of first, second, and third electrode segments each having apertures through which the electron beams pass, individually; and third electron means for converging the electron beams passing through the second electrode means on the phosphor screen; deflection means for deflecting the electron beams to be landed on the phosphor screen from the electron gun means in horizontal and vertical directions; and voltage applying means for applying a first variable voltage to the first and third electrode segments and applying a second constant voltage to the second electrode segment, the first variable voltage being varied in accordance with the deflection of the electron beam, whereby asymmetrical electron lenses are formed between the first and second electrode segments and between the second and third electrode segments, so that each of the electron beams passing through the electron lenses is deformed into a vertically elongated oval shape.

BRIEF DESCRIPTION OF THE DRAWINGS

FIGS. 5A and 5B show waveforms of a deflection current supplied to the deflection yoke and a dynamic voltage signal applied to electrodes of the electron gun assembly of FIG. 4, the signal varying depending on the current;

FIG. 6 is a plan view schematically showing a path of electron beams within horizontal and vertical planes and a convergent surface for the beams, in the prior art color cathode ray tube incorporating the electron gun assembly shown in FIG. 4;

DETAILED DESCRIPTION OF THE PREFERRED EMBODIMENTS

Figure 1A:
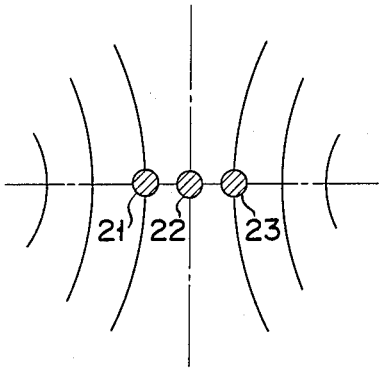
FIG. 1A (PRIOR ART)
FIGS. 1A and 1B show an example of distribution of conventional horizontal- and vertical-deflection magnetic fields formed in a color cathode ray tube by means of a deflection yoke.
Figure 1B:
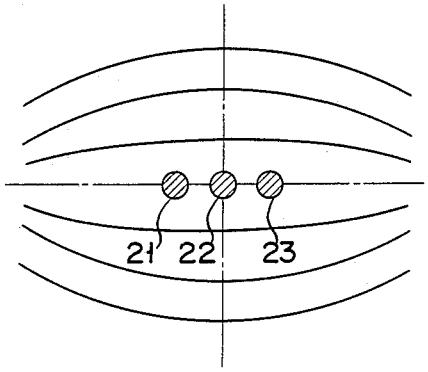
FIG. 1B (PRIOR ART)
Figure 2:
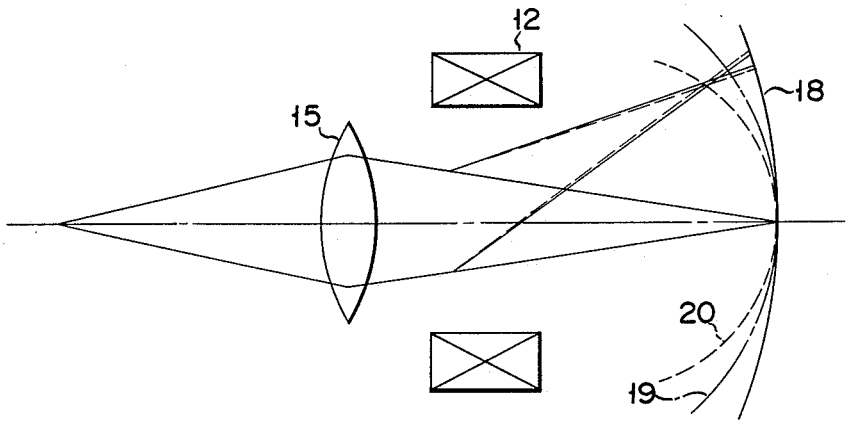
FIG. 2 (PRIOR ART)
FIG. 2 is a plan view schematically showing a path of electron beams within horizontal and vertical planes and a convergent surface for the beams, in a prior art color cathode ray tube.
Figure 3:
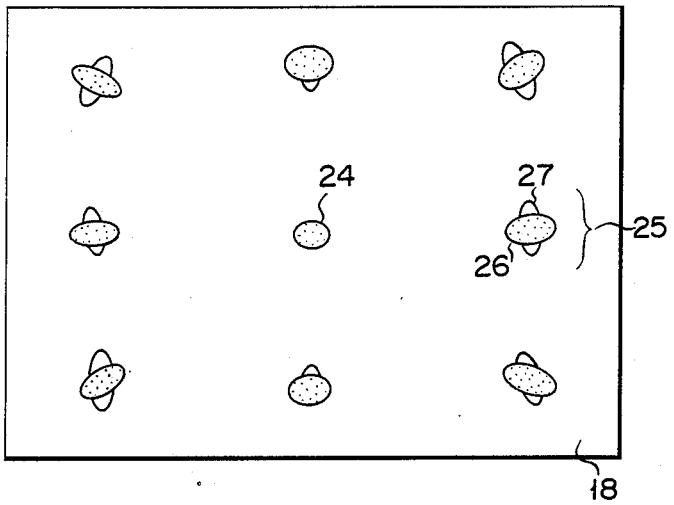
FIG. 3 (PRIOR ART)
FIG. 3 is a plan view schematically showing the shape of beam spots on a phosphor screen of the prior art color cathode ray tube.
Figure 7:
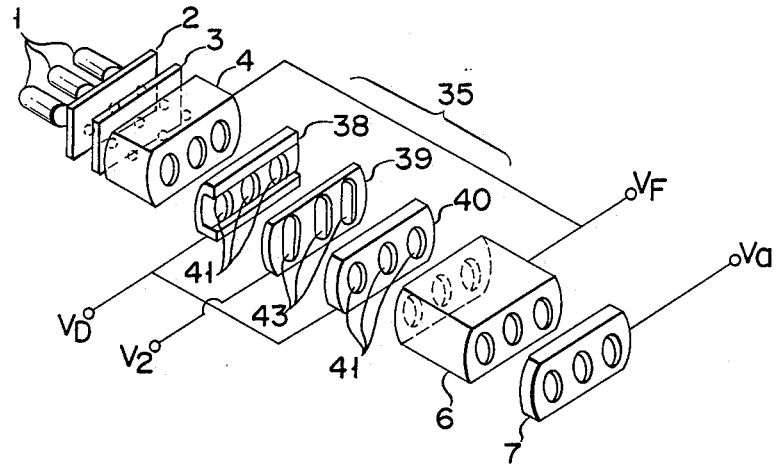
FIG. 7 is a perspective view schematically showing an electrode arrangement of an electron gun assembly incorporated in a color cathode ray tube according to the present invention.
Figure 8A:
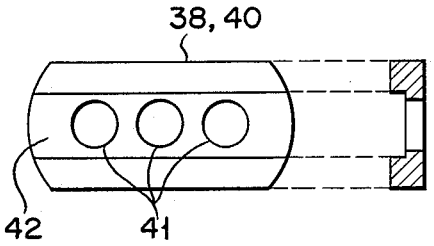
FIGS. 8A and 8B are plan views of the electrodes shown in FIG. 7.
Figure 8B:
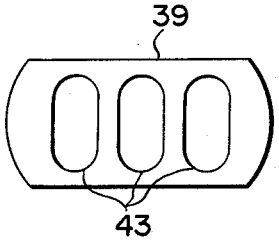

FIG. 7 shows an electrode arrangement of a quadrapotential electron gun assembly of an in-line type incorporated in a color cathode ray tube according to an embodiment of the present invention. This electron gun assembly, which has the same electrode arrangement as the one shown in FIG. 4, comprises cathodes 1 and first, second, third, fourth, fifth, and sixth grids 2, 3, 4, 35, 6 and 7. Fourth grid 35 is composed of first, second, and third members 38, 39 and 40. Each of first and third members 38 and 40 has groove 42 extending in the horizontal direction and faced to second member 39, and three circular electron beam apertures 41 formed in the groove, as shown in FIG. 8A, while second member 39 has vertically elongated rectangular electron beam apertures 43 arranged horizontally. In this electrode arrangement, electron beams emitted from cathodes 1 are focused on a phosphor screen by means of sub-lenses, which are formed between third and fourth grids 4 and 35 and between fourth and fifth grids 35 and 6, and a main lens between fifth and sixth grids 6 and 7. Then, the electron beams are landed on the phosphor screen after passing through magnetic fields formed by a deflection yoke 12, e.g., a horizontal deflection field of a pincushion type, as shown in FIG. 1A, and a vertical deflection field of a barrel type, as shown in FIG. 1B.

In operation, the following potentials are applied to the individual electrodes. A DC potential of 50 to 150 V is applied to cathodes 1; 0 V to first grid 2, 600 to 800 V to second grid 3, 8 kV (VF) to third and fifth grids 4 and 6, and 27 kV (Va) to sixth grids 7.

Figure 4:
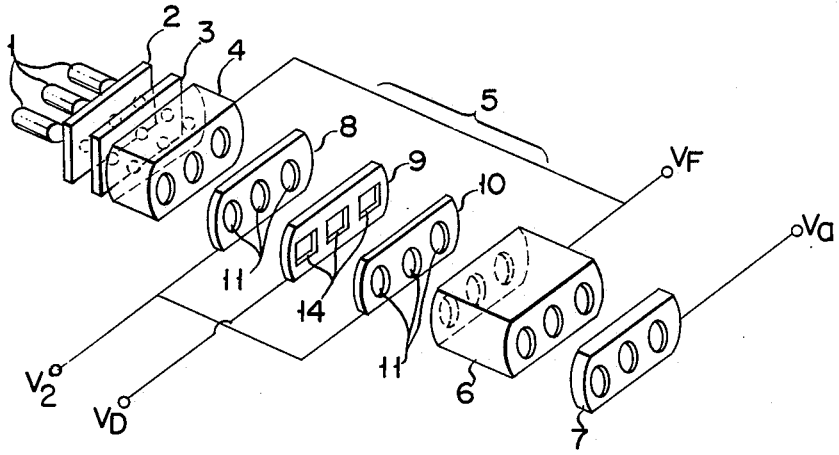
FIG. 4 (PRIOR ART)
FIG. 4 is a perspective view schematically showing an electrode arrangement of an electrode gun assembly incorporated in the prior art color cathode ray tube.
Figure 9:
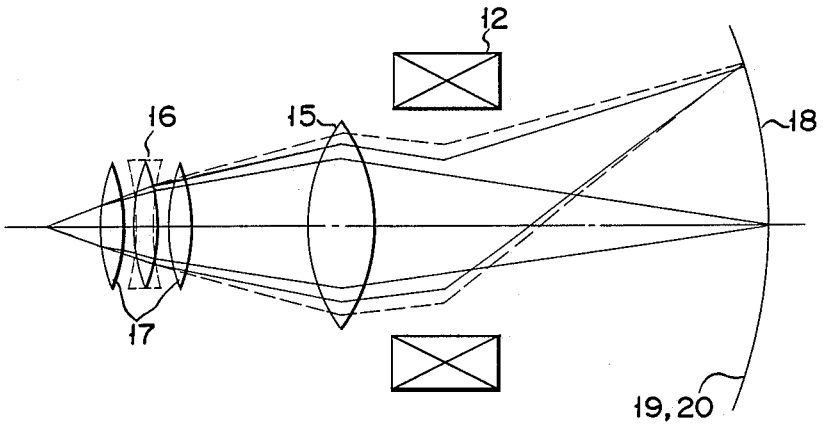
FIG. 9 is a schematic view of an electrooptical system schematically showing a path of electron beams emitted from the electron gun assembly in the color cathode ray tube and a convergent for the beams within horizontal and vertical planes.

In the electron gun assembly shown in FIG. 7, unlike the electron gun assembly shown in FIG. 4, a DC potential of 600 to 800 V is applied to second member 39 of fourth grid 35, as well as to second grid 3. First and third members 38 and 40 of fourth grid 35 are supplied with dynamic voltage 29 which changes in synchronism with deflection current 28 applied to deflection yoke 12, as shown in FIG. 5B. If the amount of deflection of the electron beams is zero, dynamic voltage Vd has the same level as predetermined voltage V2. As the deflection amount increases, the level of voltage Vd rises gradually from V2. Thus, in the electron gun assembly with members 38 and 40 of fourth grid 5 supplied with such dynamic voltage Vd, if the deflection amount of the electron beams is zero, voltage Vd has the same level as predetermined voltage V2. In this case, therefore, asymmetrical lenses 16, as shown in FIG. 9, are not formed between first and second members 38 and 39 or between second and third members 39 and 40 of fourth grid 35. Only symmetrical sub-lenses 17 are formed individually between third grid 4 and first member 38 of fourth grid 35 and between fifth grid 6 and third member 40 of fourth grid 35. If the deflection amount of the electron beams increases, dynamic voltage Vd rises from the level of predetermined voltage V2. Accordingly, asymmetrical lenses 16 are formed between first and second members 38 and 39 of fourth grid 35 and between second and third members 39 and 40, as shown in FIG. 9. Thus, the converging effect of symmetrical sub-lenses, formed between third grid 4 and first member 38 of fourth grid 35 and between fifth grid 6 and third member 40 of fourth grid 35 is weakened.

Asymmetrical lenses 16, formed between first and second members 38 and 39 of fourth grid 35 and between second and third members 39 and 40, exert a weak converging effect on the electron beams within the horizontal plane, and a diverging effect thereon within the vertical plane. After passing through asymmetrical lenses 16, therefore, electron beams are deformed into the shape of an oval having its major axis within the vertical plane. Thus, the focusing planes within the horizontal and vertical directions are made coincident, that is, the second deflective aberration is compensated.

Moreover, the converging effect of symmetrical sub-lenses 17, which are formed between third grid 4 and first member 38 of fourth grid 35 and between fifth grid 6 and third member 40 of fourth grid 35, is weakened. Therefore, the electron beams are subjected to an effect such that the beam spots within the vertical and horizontal planes are under-focused on phosphor screen 18. Thus, the beam spots are prevented, by the first deflective aberration, from being over-focused within the vertical and horizontal planes. As a result, the focusing plane within the horizontal and vertical directions move toward phosphor screen 18 to be in a alignment therewith. Thus, the first deflective aberration is compensated.

In the electron gun assembly shown in FIG. 7, the converging intensity of sub-lenses 17 shown in FIG. 9 is high enough to ensure a satisfactory effect of compensating the first deflective aberration. Thus, both the first and second deflective aberrations can be compensated in an optimum manner by means of signal dynamic voltage Vd. As a result, the deflective aberrations in the peripheral region of the phosphor screen are thoroughly suppressed, so that the beam sports are minimized in size. Thus, the resolution in the peripheral region can be improved considerably.

According to an experiment, the optimum value of dynamic voltage Vd obtained during diagonal deflection of the electron beams toward the peripheral region of the phosphor region was about 500 V, as compared with DC voltage V2 of 600 to 800 V applied to the second member of the fourth grid. Since the maximum value of dynamic voltage Vd is as low as about 1,300 V or less, the arrangement for voltage supply does not require any special consideration. Thus, the reliability of the electron gun assembly, including its withstand voltage characteristic, is high.

Figure 10:
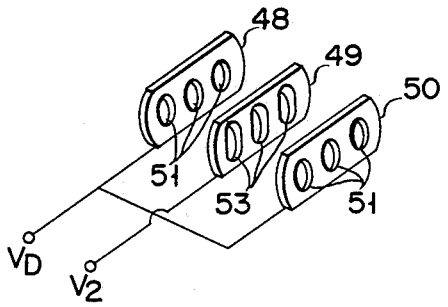
FIGS. 10 and 11 are perspective views schematically showing modifications of the electrode arrangement of FIG. 7.

The effect of the present invention can be also fulfilled by the following arrangement. In this arrangement, as shown in FIG. 10, first and third members 48 and 50 of a fourth grid each have circular electron beam apertures 51, and second member 49 has vertically elongated electron beam apertures 53. In this case, as in the case of the embodiment described above, dynamic voltage 29 shown in FIG. 5B is applied to first and third members 48 and 50, and predetermined voltage V2 is applied to second member 49.

Figure 11:
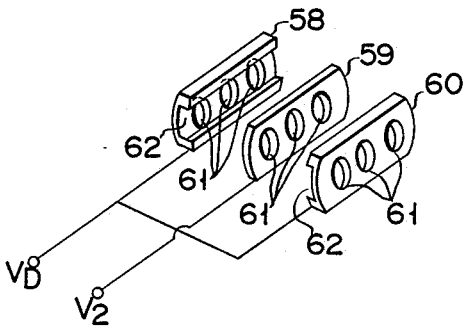

The same effect can be also provided by an arrangement such that first and third members 58 and 60 of a fourth grid each have circular electron beam apertures 61 and horizontally elongated groove 62 facing second member 59, and second member 59 has circular electron beam apertures 61, as shown in FIG. 11.

According to the embodiment described above, voltages V2 applied to second member 59 of the fourth grid is equivalent to the voltage applied to second grid 3. However, the present invention is not limited to such an arrangement, and the same effect can be obtained as long as voltage V2 is constant.

According to the present invention, constructed in this manner, the deflective aberration attributable to the nonuniformity of the deflection fields and the deflective aberration attributable to the extended path of electron beams from the electron guns to the phosphor screen can both be compensated by applying one relatively low dynamic voltage. Thus, satisfactory resolution can be obtained throughout the phosphor screen.

What is claimed is:

1. A color cathode ray tube assembly having a horizontal plane and a vertical plane normal to the horizontal plane comprising:

a phosphor screen;

quadra-potential electron gun means for generating and directing three electron, beams toward the phosphor screen, said electron gun means including:

(a) cathode means, comprised of three cathodes which are arranged in a line, for emitting the three electron beams in the horizontal plane;

(b) first electrode means, comprised of first, second and third grid electrodes separated from each other, for forming prefocus lenses to accelerate and control the electron beams emitted from said cathode means, respectively, by a constant amount;

(c) second electrode means, comprised of a fourth grid assembly which includes first, second and third electrode segments separated from each other and closely arranged, for forming asymmetrical lenses each having a lens power to converge the accelerated and controlled electron beams in the horizontal plane and diverge the accelerated and controlled electron beams in the vertical plane, respectively and for forming first symmetrical sublenses with said first electrode means for converging the electron beams, each having a lens power which is dynamically changed in accordance with the deflection amount of the electron beam on one said side of said asymmetrical lenses closer to said cathode means; and (d) third electrode means, comprised of fifth sixth grid electrodes separated from each other, for forming symmetrical main lenses to focus the electron beams passing through said second electrode means onto the phosphor screen by a constant focusing amount, respectively and for forming second symmetrical sublenses with said second electrode means on another side of said asymmetrical lenses farther from said cathode means for converging the electron beam, each having a lens power which is dynamically changed in accordance with the deflection of the electron beam;

first connecting means for connecting the third grid electrode to the fifth grid electrode;

second connecting means for connecting the first segment to the third segment;

first voltage applying means for applying a high voltage through said first connecting means to the third and fifth grid electrodes to maintain the third and fifth grid electrodes at a same potential level;

second voltage applying means for applying a D.C. constant potential to the second electrode segment; and third voltage applying means for applying a dynamic voltage through said second electrode segment to the first and third electrode segments, having a dynamic level which is lower than the high potential level applied to said third and fifth grid electrodes when a deflection amount of the electron beams is other than zero, and is varied in accordance with the deflection amount of the electron beams, wherein the first and second symmetrical sublenses dynamically focus the electron beams onto the phosphor screen, and the lens power of the asymmetrical electron lenses formed in said second electrode means is dynamically changed in accordance with the deflection of the electron beams so that each of the electron beams is vertically elongated to have an elliptical shape.

2. The color cathode ray tube according to claim 1, wherein said first and third electrode segments each have circular apertures through which the electron beams pass individually, and said second electrode segment has slots with a vertical longitudinal axis through the electron beams pass individually.

3. The color cathode ray tube according to claim 1, wherein said first and third electrode segments each have a groove extending in the horizontal direction and facing the second electrode segment.

4. The color cathode ray tube according to claim 1, wherein said first, second, and third electrode segments each have circular apertures through which the electron beams pass individually and said first and third electrode segments each have a horizontal groove extending in the horizontal direction and facing the second electrode segment.

5. A cathode ray tube assembly as in claim 1, wherein said third grid electrode, and said fifth grid electrode are each elongated structures having two spaced surfaces facing in opposite directions.

6. A cathode ray tube assembly as in claim 5, wherein one of said surfaces of said third grid electrode forms said prefocus lenses with said second grid electrode, and the other of said surfaces forms said first sublenses with said first electrode segment, and wherein one of said surfaces of said fifth grid electrode forms said second sublenses with said third electrode segment, and the other of said surfaces forms said main lenses with said sixth grid electrode.

7. A color cathode ray tube assembly adapted for focusing electron beams towards a phosphor screen, comprising:

three cathodes arranged in a line for emitting three electron beams in a horizontal plane;

a first grid electrode for prefocusing said electron beams;

a second grid electrode having a first surface which forms prefocus lenses which prefocus said electron beams by constant amounts, with said first electrode;

a third electrode adapted for forming first sublenses with a second surface of said second electrode;

fourth and fifth electrodes forming, with said third electrode, an asymmetric lens having a lens power which converges said electron beams in the horizontal plane and diverges the beams in the vertical plane;

a sixth electrode, having a first surface for forming second sublenses on a different side of said asymmetric lens than said first sublenses, said second sublenses having a same lens power as said first sublenses;

a seventh electrode for forming a main lens which focuses by a constant amount with another surface of said sixth electrode; and means for applying respective voltages to said electrodes.

* * * * *